US006160232A

United States Patent [19]

Lin

[11] Patent Number: 6,160,232

[45] Date of Patent: Dec. 12, 2000

[54] PUSH BUTTON OF COMPUTER BEZEL

[75] Inventor: Jonas Lin, Lin-Ko, Taiwan

[73] Assignee: Hon Hai Precision Ind. Co., Ltd., Taipei Hsien, Taiwan

[21] Appl. No.: 09/437,436

[22] Filed: Nov. 17, 1999

[30] Foreign Application Priority Data

Jul. 2, 1999 [TW] Taiwan ..... 88211062

[51] Int. Cl.[7] ..... H01H 13/00

[52] U.S. Cl. ..... 200/341; 200/296; 200/520

[58] Field of Search ..... 200/5 R, 5 A, 200/520, 296, 338, 341, 343–345; 400/490, 491, 491.2, 495, 495.1, 496

[56] References Cited

U.S. PATENT DOCUMENTS 4,311,893 1/1982 Tsuchiya et al. ..... 200/340
4,638,151 1/1987 Suwa ..... 235/145 R
5,927,483 7/1999 Yamada ..... 200/343
5,990,432 11/1999 Kuroda ..... 200/343
6,002,093 12/1999 Hrehor, Jr. et al. ..... 200/345

*Primary Examiner*—Michael Friedhofer
*Attorney, Agent, or Firm*—Wei Te Chung

[57] ABSTRACT

A push button assembly adapted to be mounted to a bezel includes a button body and a pair of anchoring members arranged on opposite sides of the button body and connected to the button body by resilient arms for resiliently supporting the button body. Each anchoring member forms a plurality of ledges for being interferentially inserted into and engaging with a corresponding hole defined in the bezel thereby mounting the button body to the bezel. The bezel defines a bore through which a post extending from the button body extends for being accessible to a user. The button body has an inner end adapted to drivingly engage with a switch whereby when the post is depressed, the button body moves under the resilient support of the resilient arms to engage with and thus actuate the switch.

15 Claims, 5 Drawing Sheets

PUSH BUTTON OF COMPUTER BEZEL

BACKGROUND OF THE INVENTION

The present invention relates to a push button of a personal computer bezel, and especially to a push button which can be readily assembled to a computer bezel.

A computer bezel normally has a plurality of push buttons for controlling operations thereof including at least a power switch and a system reset switch. In accordance with the structure, push buttons may be generally divided into two types.

Referring to FIG. 1 of the attached drawings, a conventional push button 110 of the first type is mounted on an inner surface of a bezel 112. The push button 110 comprises an elongate body forming a fixing portion 114 and an actuating portion 116 on opposite ends thereof. A press portion 118 is formed between the fixing portion 114 and the actuating portion 116 of the push button 110 and is accessed by a user for being depressed to cause the actuating portion 116 to pivot about the fixing portion 114, thereby controlling a switch (not shown). The fixing portion 114 defines two holes 120 into which two posts 122 extending from the bezel 112 are received. Free ends of the posts 122 are thermally deformed for securely mounting the fixing portion. Thermally deforming the posts 122 to mount the push button 110 to the bezel 112, however, is laborious and time consuming.

FIG. 2 of the attached drawings shows a conventional push button 124 of a second type, comprising a cap 126 supported by a spring 128. The cap 126 includes an actuating post 130 extending therefrom and three latches 132 arranged around the actuating post 130. A bezel 134 forms a receiving portion 136 for receiving the push button 124. The receiving portion 136 defines a central bore 140 for movably receiving the actuating post 130 and three cutouts 138 for receiving and engaging with the latches 132 thereby attaching the push button 124 to the bezel 134 with the cap 126 biased by the spring 128. Such a structure of the push button 124, however, is complicated.

Thus, a push button having a simple structure which can be readily assembled and thus solves the problems of the prior art is desired.

SUMMARY OF THE INVENTION

An object of the present invention is to provide a push button that is capable of being readily assembled.

Another object of the present invention is to provide a push button having a simple structure.

According to the present invention, a push button assembly comprises a press portion and a pair of fixing portions arranged on opposite sides of the press portion and connected to the press portion by a resilient arm for resiliently supporting the press portion. Each fixing portion forms a plurality of ledges for being interferentially inserted into and engaging with a corresponding hole defined in the bezel thereby mounting the press portion to the bezel. The bezel defines a bore through which a post extending from the press portion extends for being accessible to a user. The press portion has an inner end for drivingly engaging with a switch whereby when the post is depressed, the press portion moves under the resilient support of the resilient arms to engage with and thus actuate the switch.

Other objects, advantages and novel features of the invention will become more apparent from the following detailed description of a preferred embodiment thereof when taken in conjunction with the accompanying drawings, wherein:

DETAILED DESCRIPTION OF THE PREFERRED EMBODIMENT

Figure 1:
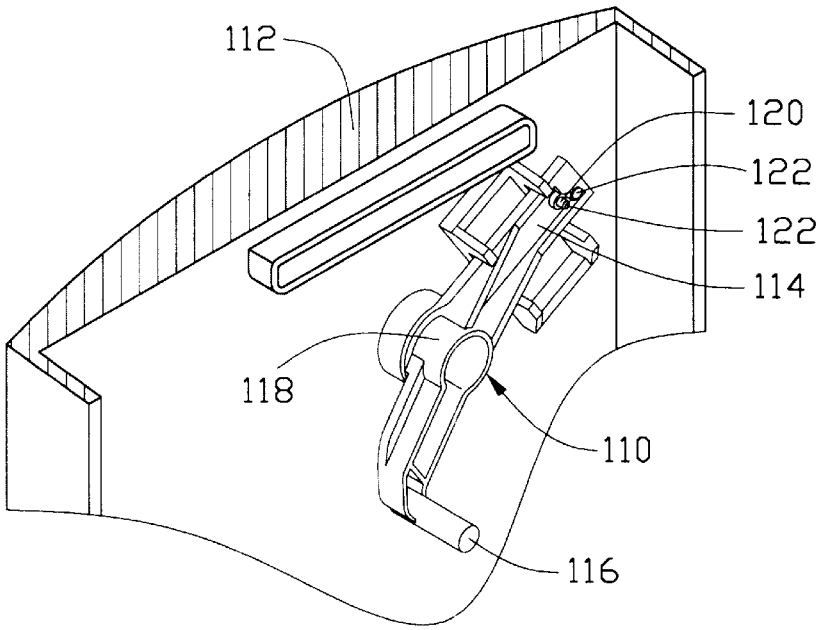
FIG.1 (PRIOR ART)
FIG. 1 is a perspective view of a first conventional push button.
Figure 2:
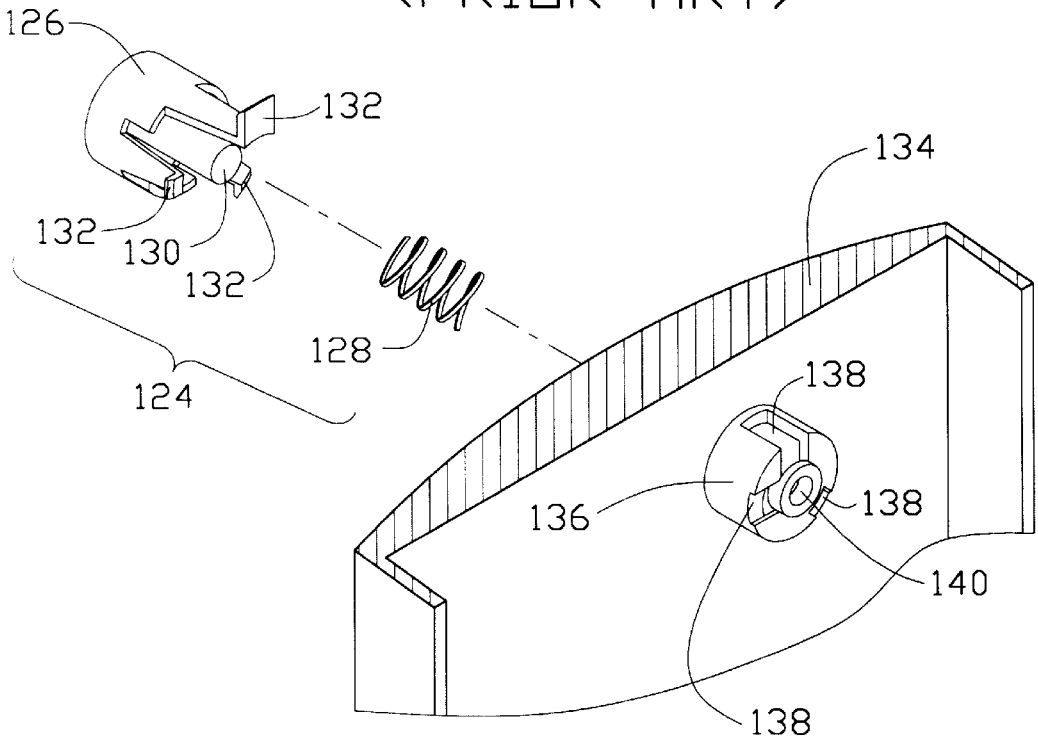
FIG.2 (PRIOR ART)
FIG. 2 is an exploded view of a second conventional push button.
Figure 3:
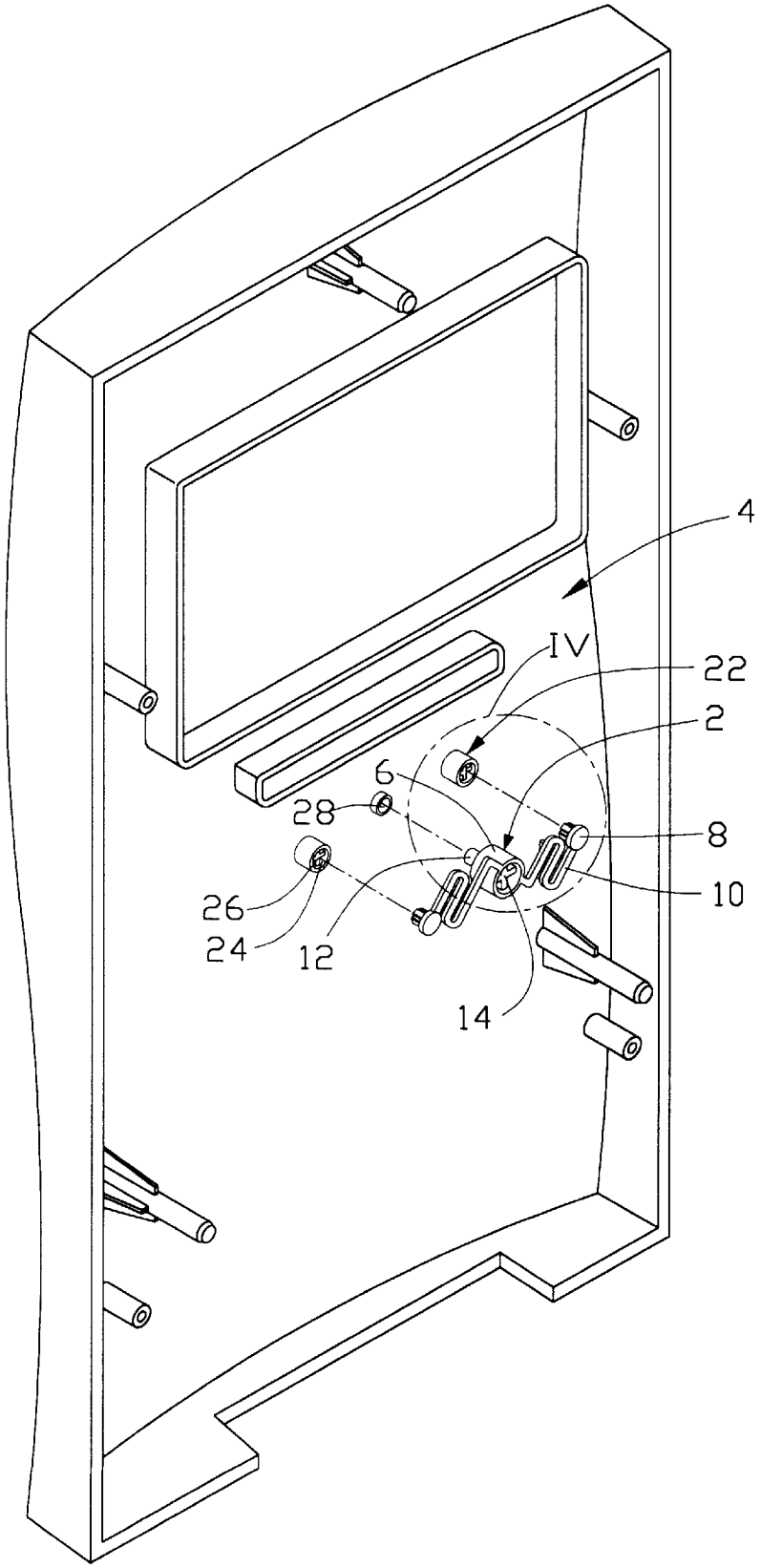
FIG. 3 is an exploded view of a push button assembly in accordance with the present invention.
Figure 4:
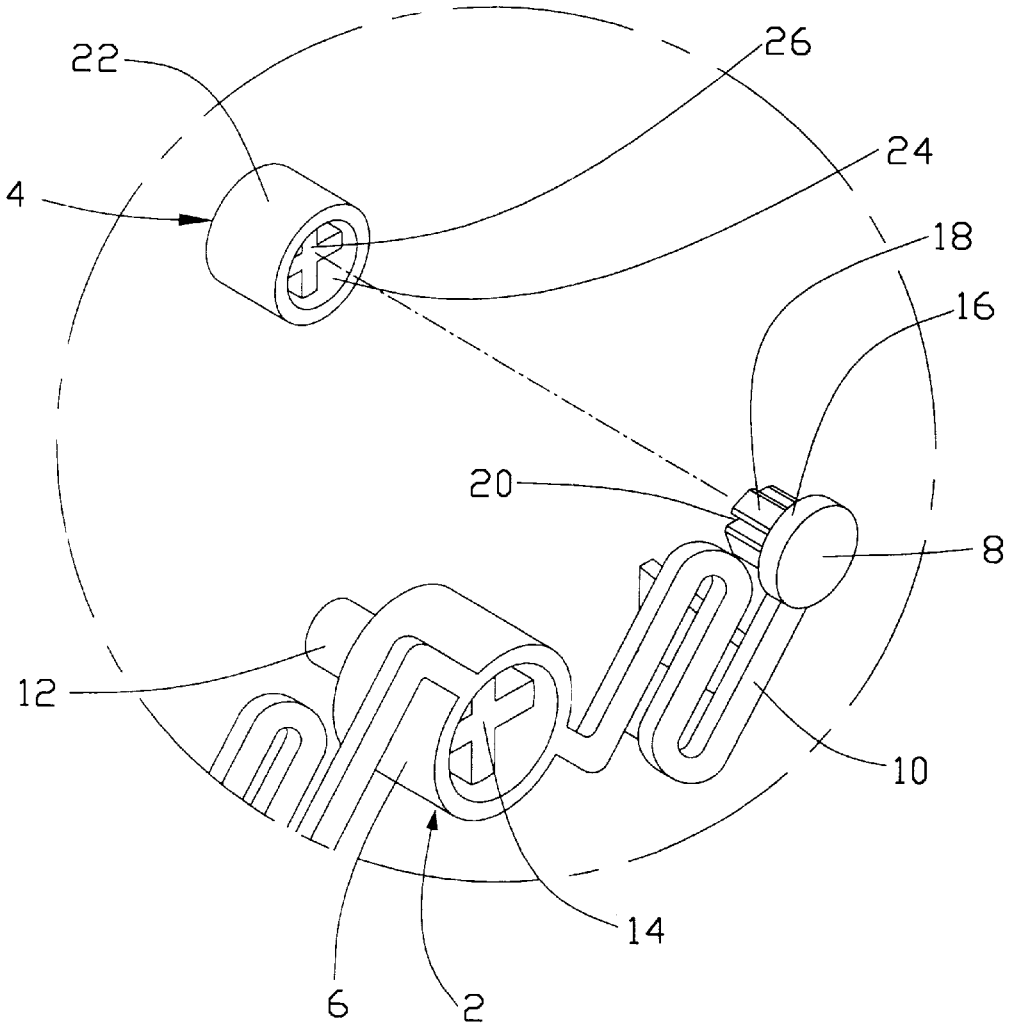
FIG. 4 is an enlarged view of the encircled portion IV of FIG. 3.
Figure 5:
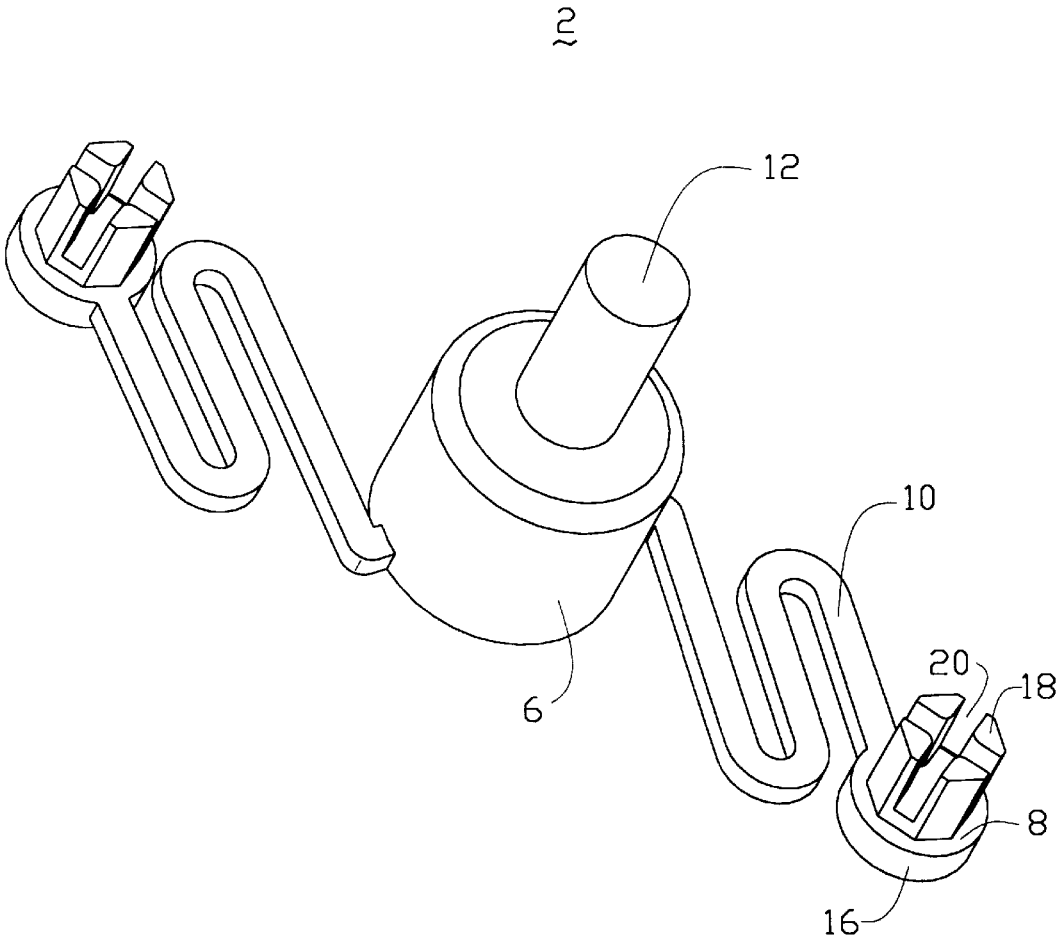
FIG. 5 is a perspective view of the push button of the present invention.

Referring to the drawings and in particular to FIGS. 3–5, a push button 2 constructed in accordance with the present invention is mounted on an inner surface of a bezel 4 for controlling a switch (not show). The push button 2 comprises a press portion 6 and a pair of fixing portions 8 on opposite sides of the press portion 6 and respectively connected thereto by a pair of resilient arms 10. The press portion 6 comprises a post 12 movably and axially extending through a bore 28 defined in the bezel 4 for being accessible to a user. The press portion 6 has an end opposite the post 12 for engaging with and actuating the switch. In the embodiment illustrated, the press portion 6 comprises a hollow cylinder in which an internal engaging member 14 formed by two ribs having a cross configuration is mounted for engaging with the switch. However, it is apparent to those having ordinary skill in the art to replace the internal member 14 with a closed end portion of the cylinder or the like.

Each fixing portion 8 comprises a base 16 from which four ledges 18 extend. The ledges 18 are spaced from each other and define a cruciform gap 20 thereamong.

A pair of sockets 22 are formed in the bezel 4 for receiving the fixing portions 8. Each socket 22 defines a central hole 24 in which a cruciform member 26 is fixed. The cruciform member 26 forms four quadrants for interferential insertion of the ledges 18.

Figure 6:
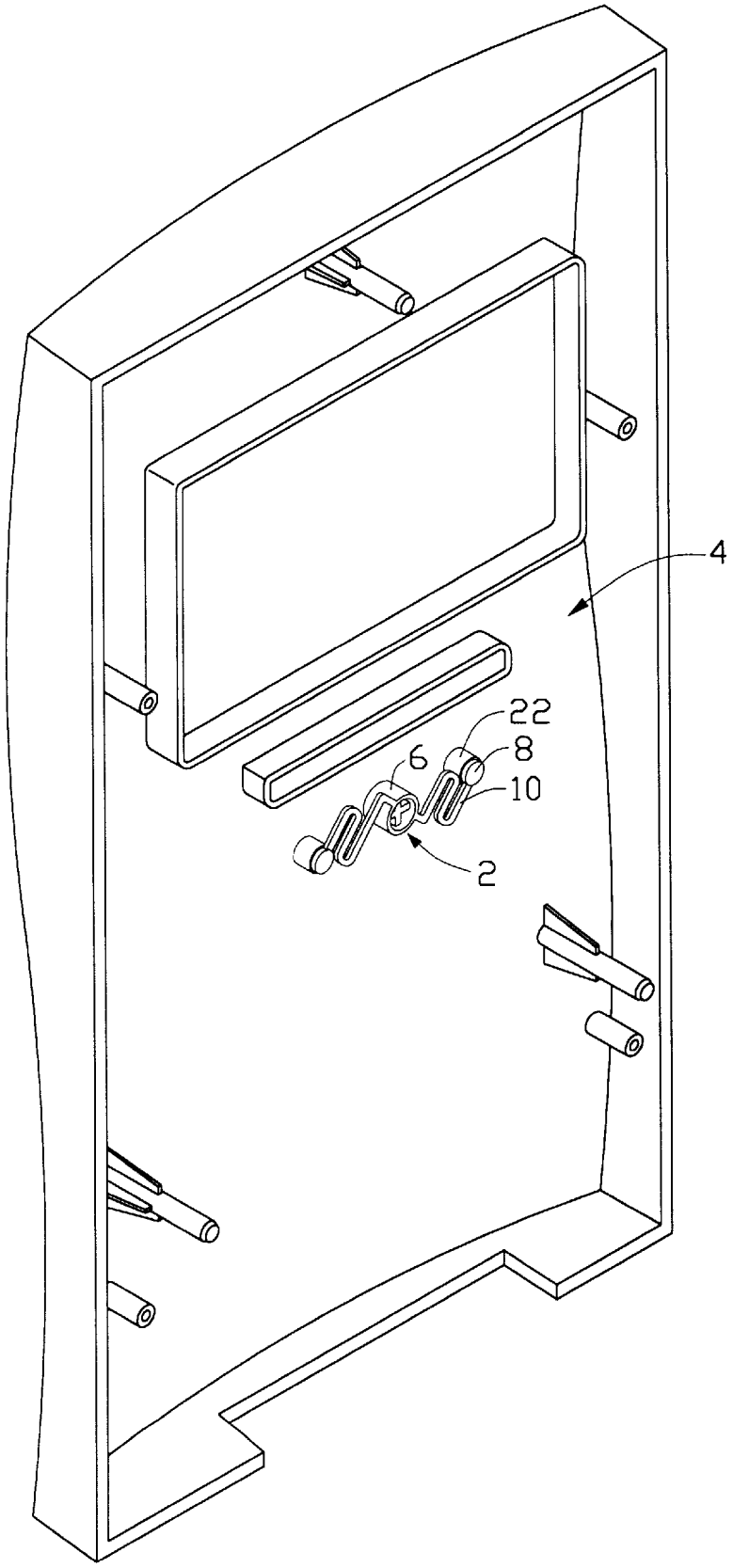
FIG. 6 is an assembled view of FIG. 3.

Referring to FIG. 6, the fixing portions 8 of the push button 2 are securely received in the sockets 22 with the cruciform members of the sockets 22 interferentially engaging with the gaps 20 of the fixing portions 8 whereby the push button 2 is securely fixed to the bezel 4 with the post 12 of the push button 2 extending through the bore 28 of the bezel 4. When the post 12 is depressed, the press portion 6 moves under the resilient support of the resilient arms 10 and the internal member 14 thereof actuates the switch.

It is understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. A push button assembly for being mounted to a bezel, comprising:

a press portion for being movably received in a bore defined in the bezel;

at least one fixing portion forming an extension which forms at least two spaced ledges defining a gap therebetween for being interferentially received in a receiving portion formed in the bezel; and a resilient arm connecting the press portion to the at least one fixing portion thereby resiliently supporting the press portion on the bezel.

2. The push button assembly as claimed in claim 1, wherein the extension of the fixing portion forms four ledges defining a cruciform gap thereamong for being interferentially received in and engaging with the receiving portion.

3. The push button assembly as claimed in claim 1, wherein there are two fixing portions arranged on opposite sides of the press portion and two resilient arms connected between the fixing portions and the press portion for resiliently supporting the press portion.

4. The push button assembly as claimed in claim 1, wherein the press portion forms a post on a first end thereof, the post extending beyond the bezel through the bore.

5. The push button assembly as claimed in claim 4, wherein the press portion forms a second end to contact and drivingly engage with a switch.

6. A bezel assembly comprising:

a bezel body defining a bore and forming at least one receiving portion which defines a hole; and a push button comprising:

a press portion movably received in the bore of the bezel;

at least one fixing portion forming an extension interferentially received in the corresponding hole of the receiving portion of the bezel for attaching the fixing portion to the bezel; and a resilient arm connecting the press portion to the fixing portion thereby resiliently supporting the press portion on the bezel.

7. The bezel assembly as claimed in claim 6, wherein the extension of the fixing portion forms at least two spaced ledges defining a gap therebetween and wherein a rib is formed inside the hole of the receiving portion for interferential insertion into and engagement with the gap between the ledges of the fixing portion.

8. The bezel assembly as claimed in claim 7, wherein the extension of the fixing portion forms four ledges defining a cruciform gap thereamong and wherein two ribs intersecting each other and forming a cruciform configuration are fixed inside the hole of the receiving portion for being interferentially received in and engaging with the cruciform gap of the fixing portion.

9. The bezel assembly as claimed in claim 6, wherein there are two fixing portions arranged on opposite sides of the press portion and two resilient arms connected between the fixing portions and the press portion for resiliently supporting the press portion.

10. The bezel assembly as claimed in claim 6, wherein the press portion forms a post on a first end thereof, the post extending beyond the bezel through the bore.

11. The bezel assembly as claimed in claim 10, wherein the press portion forms a second end to contact and drivingly engage with a switch.

12. A bezel assembly comprising:

a bezel body defining a bore and a pair of sockets by two sides of said bore; and a push button comprising:

a press portion movably received within the bore of the bezel;

a pair of fixing portions respectively secured to the corresponding sockets of the bezel; and a pair of resilient arms each connecting the press portion to the corresponding fixing portion thereby resiliently supporting the press portion on the bezel.

13. The assembly as claimed in claim 12, wherein said pair of resilient arms have an equal length with each other for providing balanced and even support on the press portion.

14. The assembly as claimed in claim 12, wherein said press portion includes an engagement member which is coaxial with the bore.

15. A push button assembly for being mounted to a bezel, comprising:

a press portion for being movably received in a bore defined in the bezel;

at least one fixing portion forming an extension for being interferentially received in a receiving portion formed in the bezel; and a resilient arm connecting the press portion to the at least one fixing portion thereby resiliently supporting the press portion on the bezel; wherein the extension of the fixing portion forms four ledges defining a cruciform gap thereamong for being interferentially received in and engaging with the receiving portion.

* * * * *